United States Patent [19]

Grimshaw et al.

[11] 4,300,266

[45] Nov. 17, 1981

[54] FLATS FOR CARDING MACHINES

[75] Inventors: Keith Grimshaw, Todmorden; Brian J. Ennis, Sowerby Bridge, both of England

[73] Assignee: The English Card Clothing Company Limited, England

[21] Appl. No.: 75,030

[22] Filed: Sep. 13, 1979

[30] Foreign Application Priority Data

Sep. 14, 1978 [GB] United Kingdom ..... 36771/78

[51] Int. Cl.[3] ..... D01G 15/24

[52] U.S. Cl. ..... 19/113

[58] Field of Search ..... 19/102, 103, 104, 110, 19/111, 113

[56] References Cited

U.S. PATENT DOCUMENTS

| | | | |
|---|---|---|---|
| 684,703 | 10/1901 | Mills | 19/113 |
| 2,562,998 | 8/1951 | Banfield | 19/113 |
| 3,302,667 | 2/1967 | Urquhart et al. | 139/159 |
| 3,662,439 | 5/1972 | Baken | 28/269 |

FOREIGN PATENT DOCUMENTS

| | | | |
|---|---|---|---|
| 2742420 | 3/1979 | Fed. Rep. of Germany . | |
| 798102 | 10/1935 | France . | |
| 375636 | 4/1964 | Switzerland . | |
| 447689 | 5/1936 | United Kingdom . | |
| 666185 | 2/1952 | United Kingdom . | |
| 681885 | 10/1952 | United Kingdom . | |
| 1309229 | 7/1971 | United Kingdom . | |
| 1499810 | 2/1978 | United Kingdom | 19/102 |
| 1543334 | 4/1979 | United Kingdom . | |

*Primary Examiner*—Louis Rimrodt

*Attorney, Agent, or Firm*—W. Thad Adams, III

[57] ABSTRACT

The invention relates to flats as used in carding machines in which there is a releaseable component at one or each end, this component having a surface for frictional engagement on the carding machine and the component being self-retaining on the flat. Spring clip type components are described and there is also a flat made as an extrusion with end parts machined off to adapt the flat to receive the releaseable components.

3 Claims, 4 Drawing Figures

FLATS FOR CARDING MACHINES

The flat as used in a revolving flat cotton type carding machine is usually made as a casting, and essentially comprises a clothing flange with a machined underside to receive the card-clothing top, a rib extending along the length of the clothing flange, a flat-end at each end of the flat for sliding engagement on a respective bend of the carding machine, and a nug at each end which engages in the notch wheel used to drive the flats. The surface of the flat-end engages with the end of the carding machine is referred to as the bevel and the opposite surface which is engaged by the plain bowls of the machine is referred to as the back of the flat end. The precise construction of the flat varies with different carding machine manufacturers.

The conventional flat is prone to certain disadvantages, some of which have become more acute in modern high production carding.

The flat has to withstand a considerable bending load due to its weight, and due to the carding action which tends to pull the flat towards the cylinder, since the flat is a beam simply supported at its ends. (The force due to the carding action may be tangential pull, since the component of movement due to cylinder movement relative to the flat will be large). In order to withstand these inherent and applied loads, the flat has to have as large a moment of inertia as possible with the limitations imposed by the machine construction, and this has dictated the design of the flat, and to some extent, its method of manufacture.

Conventionally, flats are made from cast iron, and the casting technique used in the manufacture of the flats require highly skilled labour so that the manufacture of good quality flats is generally uneconomic in countries where the necessary skills might be available. Indeed, for this reason, it is becoming increasingly difficult to obtain good quality flats.

There is always a problem of wear on the bevels, which consequently have to be re-machined. After a few re-machinings, the flat-end becomes too thin to carry the inherent and applied loads safely, and the flat has to be discarded. The replacement flats are very expensive.

It is the object of the invention to provide a carding machine flat which will avoid or mitigate the aforementioned disadvantages.

According to one aspect of the invention a flat for use in a carding machine is provided with a releaseable component at one or each end, which component provides at least one surface for frictional engagement with a part of the carding machine and which is self-sustaining on the flat end. The releaseable component therefore provides a wear-sustaining component for the flat and by providing the wear-sustaining component as a releaseable element of the flat, it is possible to replace that component when necessary or when desired without discarding the entire flat. Obviously, it is then possible to effect considerable economies in use of the flat.

Thus, when a bevel has become worn it is possible merely to machine the flat end and replace the releaseable component, thus providing a fresh bevel surface. Clearly, when the releaseable component has in turn become worn it can be replaced by another releaseable component. Hence, it is possible to continue using an existing flat almost indefinitely. It is also possible to manufacture the flat in the first instance with flat-ends which are adapted to accept releaseable components.

Preferably the or each releaseable component embraces the flat end. It is preferred further that the or each releaseable component engages with both the bevel side and the back of the flat-end. In the preferred construction the or each releaseable component is channel-shaped in cross-section, the web of the channel forming a bevel surface for the flat-end and the flanges engaging respectively with the front and rear edges of the flat-end. Also in the preferred construction the flanges of the or each releaseable component may be formed with inturned lips engaging with the back of the flat-end.

According to another preferred feature of the invention the or each releaseable component is retained on the flat end by frictional engagement therewith. Thus, the or each releaseable component may be retained on the flat end by virtue of its own resilience. The or each releaseable component may have a spring clip engagement on the flat end, and in fact, the or each releaseable component may be made entirely of resilient material.

According to yet another preferred feature of the invention the or each releaseable component has a snap-in connection with the flat-end, and in a preferred form the or each releaseable component is provided with a resilient detent which has snap-in location in a recess formed in the flat-end.

According to a further preferred feature of the invention the body of the flat which provides the clothing flange and the essential reinforcing formation for that flange is made as an extrusion. Whilst the extrusion process is known to be relatively economic, the design of the conventional carding machine flat has been such as to preclude the use of an extrusion process from consideration. To begin with, the shape of the ends of the flat, with the flat-end portion and the nug is so different from the shape of the body of the flat that it would be practically impossible to form the shape on an extruded section. Besides, the material normally used to give the flat its required wear-resisting properties at the ends (i.e. cast iron) cannot be extruded. However it has now been appreciated, that if the wear-sustaining part of the flat is made as a releaseable component in accordance with the invention, then it is possible to manufacture the body of the flat in material which can be readily extruded.

The extrusion is preferably machined at one or both its ends to provide a location for the releaseable component. Further, a separately produced nug may be fitted into a location formed in the extrusion.

Preferably the or each releaseable component is made in a material having a greater wear-resistance on the bends of a carding machine than the material from which the flat itself is made. In a preferred construction the body is made of aluminium or aluminium alloy and the releaseable component is made in phosphorbronze.

The invention also includes a releaseable component for a flat as used in a carding machine, the component having a channel-shaped cross-section, the web of which is adapted to provide a bevel surface for the flat-end and the flanges being adapted to locate respectively on the front and rear edges of the flat-end, there being inturned lips along the edges of the flanges for engagement with the back of the flat-end, the component having a resilience such that it can grip on the flat-end for self-retention thereon, and being further provided with a resilient detent for engagement with a shoulder of the flat-end. Preferably the detent is formed between slits in the web and one of the flanges.

One of the advantages of the invention, is that it enables the releaseable component to be made in a material different from that of the remainder of the flat. Hence, it is possible to select materials for the component, which are better adapted to its particular function, than the material from which the body of the flat has to be constructed. Thus, for example, whilst the body may be made in cast iron, the releaseable component may be made in material having good tribology characteristics, for instance, wear resisting material, or material having a low coefficient of friction, with respect to the material of the part of the machine against which wear takes place.

Releaseable flat-end components for example, may be made in materials such as graphite or oil impregnated materials; sintered metals such as bronze, which may be graphite or oil impregnated; phosphor bronze; phenolic laminates (Tufnol); plastics materials and plastics materials filled with materials giving special properties, such as molybdenum disulphide filled nylon and materials impregnated or coated with polytetrafluoroethylene (P.T.F.E.).

Various flats each constructed in accordance with the invention, will now be described by way of examples only, with reference to the accompanying drawings, in which.

Figure 2:
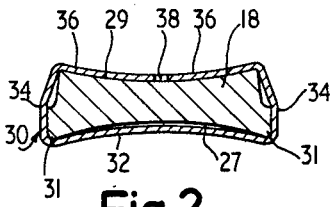
FIG. 2 is a cross-section through the end of a flat constructed as shown in FIG. 1.
Figure 1:
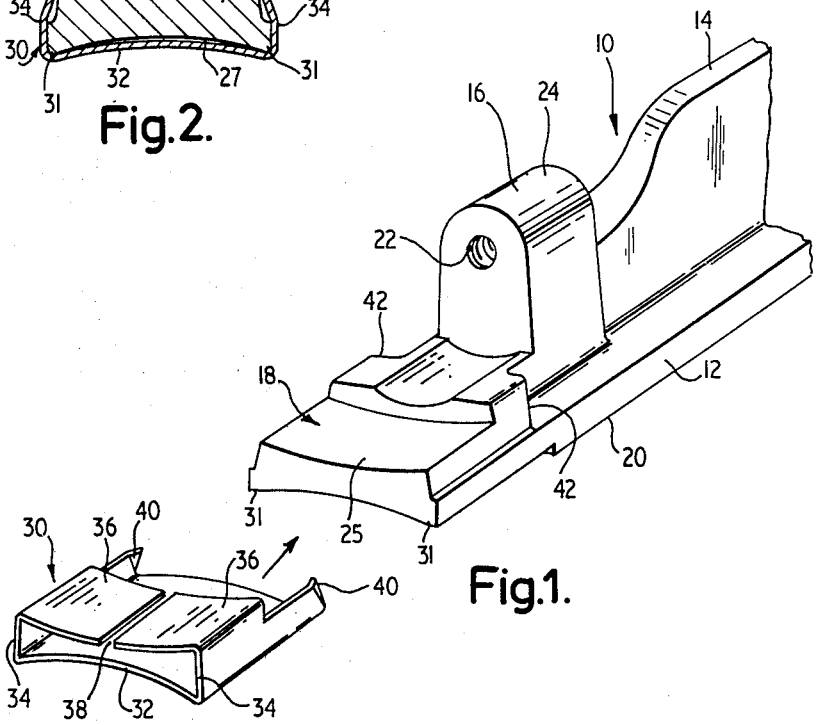
FIG. 1 is a perspective "exploded" view of one end of a flat.

Referring to FIGS. 1 and 2, there is illustrated a flat 10 of the type commonly used in the so-called revolving flat cotton type carding machine, which essentially comprises a clothing flange 12 of substantially rectangular cross-section, a rib 14 upstanding from the centre of the width of the clothing flange 12, a nug 16 formed at each end of the flat, and a flat-end 18 extending outwardly of each nug 16. The conventionally constructed flat is made in a single piece of cast iron, and the undersurface 20 which extends throughout the length of the clothing flange is machined, to receive the card-clothing top (not shown). The nug 16 is bored horizontally at 22 to receive a screw projecting from the chain which connects the flats together—and which is not illustrated—the external surface of the nug 16 being semi-cylindrical as indicated at 24 in FIG. 1 for engagement with the notch wheel by means of which the flats are caused to move.

Each flat-end 18 has to be relieved on the bevel surface (the underside as seen in FIG. 1) to leave a pair of narrow bearing strips along the longitudinal margins of the bevel, these bearing strips engaging on the bends of the carding machine, when the flat is traversing the bottom run its path, where its card-clothing co-operates with the carding machine. Also, the opposite side (back) of the flat-end is usually machined to a concave shape as indicated at 25 for engagement on the plain bowls of the machine which guide the flats at the forward and rearward ends of their traverse. A flat having the general appearance of that illustrated in FIG. 1, but constructed as a monolithic casting, is entirely conventional, and needs no further description. It should be mentioned however, that conventional flats have slightly differing designs, particularly in the shape of the rib 14, and the location of the nug 16 relatively to the rib and the clothing flange 12, and the shape of the flat-end itself.

Because the flat-ends become severely worn, particularly on the bearing parts of the bevels where they slide-on the bends of the machine, it is necessary to remove the flats from the carding machine, and the re-machine the bevels. After this has been done perhaps four to six times, according to the amount of material removed in the re-machining, the thickness of the flat-end becomes reduced, so the flat cannot be safely used. It is then necessary to discard the flat. However, in the present instance, after the first machining of the flat-end, a special wear-sustaining releaseable component 30 is fitted on to the flat-end. As a result of the first machining, the concave underside 27 of the flat-end is recessed back above the original level of the bevel surface, and the back surface 29 may also have been machined, although the back surface does not require as much machining as the bevel surface. Consequently the flat-end is rather thinner than as originally manufactured.

The component 30 is made as a pressing in work-hardened phosphor-bronze and has relatively thin walls. It is generally in the form of a box section having a bottom wall 32, side walls 34 and a top 36, the top consisting of two inturned flanges on the side walls, with a narrow gap 38 between them.

The top and bottom walls 36 and 32 of the component 30 are shaped so that the top and bottom surfaces of the component are concave in similar style to the bevel and back surfaces of the flat-end.

The component 30 is fitted on to the-machined flat-end 18 by sliding it on from the end, until the flat-end is almost totally embraced by the releaseable component as shown in FIG. 2. It will be noted that the bottom wall 32 fits closely on to the machined underside of the flat-end along the edges 31 of the flat-end, but that there is a space between the centre part of the wall 32 and the centre part of the undersurface 27. This ensures that the bottom wall 32 is properly located and receives support from the flat-end in the edge regions where wear will take place.

In the particular construction shown in FIG. 1, there are small inturned lips 40 at the inner extremities of the side walls 34, and the arrangement is such that as the component 30 is slid into position, the side walls 34 distend outwardly to allow the lips 40 to pass, but when the component is properly located, the lips 40 snap towards each other and engage with the shoulders 42 formed on the body of the flat. The lips 40 then prevent accidental displacement of the component 30, but it is possible to remove it if required by simply forcing the lips 40 away from each other to disengage them from the shoulders 42. The component 30 is then free to slide off the flat-end.

In some instances, the component 30 may be so designed that it will grip the flat-end 18 by virtue of its own resilience, without the necessity for the lips 40. A work-hardened phosphor-bronze component has an inherent resilience which will permit it to distend as it is being fitted on to the flat-end and hence it will remain in position by frictional grip on the flat-end until deliberately removed. Of course, the component could be made in other materials which would have the required resilience for this purpose.

It will be appreciated, that when the component 30 has been fitted, it provides the bevel surface of the flat-end, for engagement on the bend of the carding machine. It also provides the back for engagement with the plain bowls of the machine. When the component 30 itself becomes worn, it can simply be discarded, and replaced by a similar component. It will be appreciated therefore, that the construction illustrated in FIGS. 1 and 2 provides for relatively cheap replacement of the wearing surfaces on the flat-ends.

The phosphor-bronze from which the component 30 is manufactured has a better wear-resistance on the cast iron or steel from which the carding machine bends are made than the cast iron of the flat itself. In fact, the tribology characteristics of phosphor-bronze rubbing on cast iron or steel are very good and little or no lubrication of the flats is required, once the components 30 have been fitted to the flat-ends.

In the above description, it has been assumed that the component 30 will not be fitted until the bevel surface of the flat has had to be machined. It will be understood however that the flat could be manufactured with the components 30 fitted to its ends from new. In that case, the flat ends will never be re-machined, but the components 30 will be replaced by similar components when worn.

Figure 3:
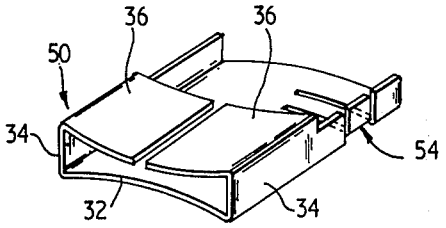
FIG. 3 is a perspective view of an alternative replaceable flat-end component.

FIG. 3 shows an alternative releaseable component 50 which is very similar to the component 30, and the same reference numerals are used for like parts. An L-shaped detent 54 is formed by cutting slits in the component, the "leg" of the L being formed in the bottom 32 and the "foot" in one of the side walls 34. This detent is pressed upwardly during manufacture, so that when fitting the component 30 onto the flat-end, it is necessary to press detent downwardly into line with the bottom wall 32 and the side wall 34. When the component 50 is in the correct endwise position on the flat-end, the detent 54 snaps into a recess machined in the bevel of the flat (this recess being provided for location of the flat in the carding machine during regrinding of the tops) and when thus engaged, in the recess, the detent locks the component 50 against endwise motion and so prevents accidental removal of the component. When the detent 54 is engaged in its recess, the shoulders formed between the detent and the remainder of the component 50 provide the location normally provided by the recess. When it is required to remove the component, the detent must be prised out of the recess, to allow the component to slide off the end of the flat.

Figure 4:
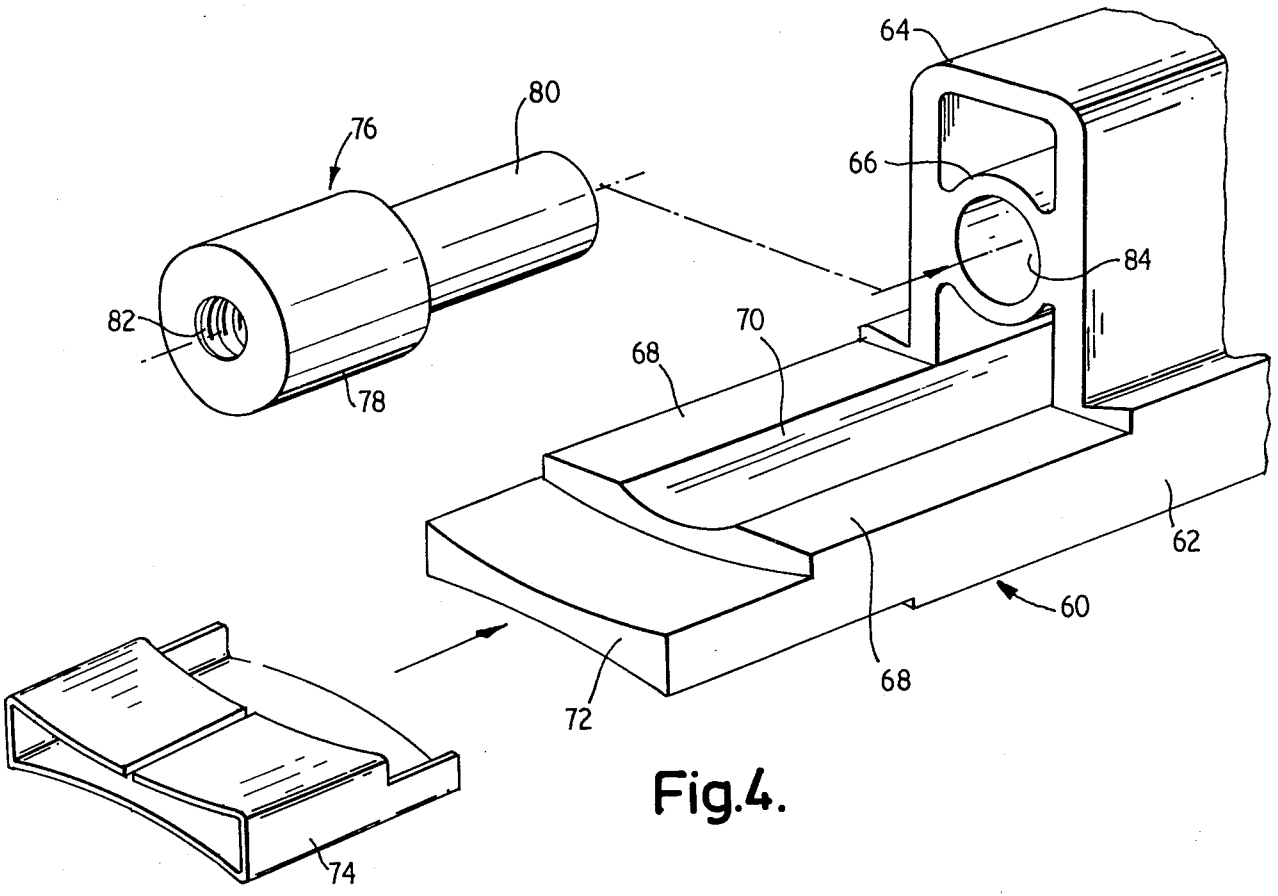
FIG. 4 is a perspective view similar to FIG. 1, but showing an alternative construction.

In FIG. 4, there is shown a flat 60, in which the body comprising the clothing flange 62 and the reinforcing rib 64 is formed as an extrusion. The rib 64 is in the form of an inverted channel with a tubular section 66 inside the channel. The extruded flat body is made in aluminium alloy, and both cost of the material and the cost of the extrusion process are relative low compared with the conventional cast iron construction. The aluminium alloy has a lower bending strength than the cast iron from which the flats are usually made, but the reduced strength is compensated for by the design of the rib 64, which of course, possesses a higher moment of inertia than the conventional slightly tapered cross-section rib. Furthermore, the extruded aluminium alloy flat is much lighter than the usual cast iron flat.

However, as extruded, the flat is of the same cross-section from end-to-end and would not be suitable for running on the bends nor would it have nugs. Moreover, the aluminium alloy would wear quite rapidly if the flat-ends were simply machined out of the extrusion.

The rib 64 is milled away at each end of the flat, leaving lands 68 with a shallow groove 70—which is in the extrusion—between them. Also, the extremity of the flat is further milled to produce a flat-end 72 of similar shape to the flat-end 18 described with reference to FIGS. 1 and 2.

Only one end of the flat is illustrated in FIG. 4, but it will be appreciated that both ends are constructed in the same way.

A releaseable component 74 is provided at each end of the flat, and this component is identical with the components 30 and 50 previously described excepting that in the component 74 it is adapted to grip on the flat end 72 entirely by its own resilience and hence it is not provided with either the lips 40 or the detent 54. Of course, releaseable components such as those shown at 30 and 50 could be employed but this would involve extra machining of the extrusion to produce shoulders 42 or a recess to accept the detent.

A separately formed nug 76 is also provided at each end of the flat. This simply takes the form of a short cylindrical bar 78 which has a radius equal to that of the semi-circular surface of the conventional nug and a spigot 80. A screw-threaded hole 82 is formed in the bar 78 to accept a setscrew of the flat chain, and the spigot 80 is a push fit into the central bore 84 of the tubular portion 66 of the flat extrusion. If necessary, this bore 84 can be machined at the end to receive the spigot, but it may be possible to extrude the bore accurately enough to avoid such machining.

Thus the construction shown in FIG. 4 provides a flat comprising five elements; that is to say: the extruded body, two releasable components and two nugs, and the assembly can be carried out entirely by pushing the releaseable components on to the flat-ends and pushing the nug spigots into the ends of the bore 84. Also, when the releaseable components or the nugs become worn, they can readily be replaced.

We claim:

1. A releasable wear-sustaining component for fitting on one end of a flat for use in a carding machine, said component having a channel-shaped cross-section, the web of said channel providing a bevel surface for said flat; the flanges of said channel being adapted to engage respectively on the front and rear edges of the flat end, said component further comprising inturned lips on said flanges adapted to engage with the back of the flat end; said releasable component having a resilience such that it is adapted to grip on the flat end for self-retention thereon and being further provided with a resilient detent for engagement with a shoulder of the flat end.

2. A flat for use on a carding machine having a card clothing support flange and end portions extending beyond respective ends of the supporting flange, each said end portion having a bevel side which faces the bend when the flat is on a carding machine; an oppositely facing back side and front and rear edges; and a releasable component fitted on each of said end portions, each said releasable component having a channel-shaped cross-section, the web of said channel providing a bevel surface for said flat; the flanges of said channel engaging respectively on the front and rear edges of the flat end portions, each said releasable component having a resilience such that it grips its respective flat end portion and is self retaining thereon.

3. A flat for use on a carding machine according to claim 2, wherein at least one of said releasable components has a resilient detent for engagement with a shoulder of its respective flat end portion.

* * * * *